United States Patent [19]

Shannon

[11] 4,380,291

[45] Apr. 19, 1983

[54] BATTERY TERMINAL CONNECTOR AND METHOD

[76] Inventor: John K. Shannon, 200 S. Vincermes Cr., Racine, Wis. 53402

[21] Appl. No.: 217,705

[22] Filed: Dec. 18, 1980

[51] Int. Cl.[3] ..... B65D 85/28

[52] U.S. Cl. ..... 206/343; 339/224; 339/227; 206/806

[58] Field of Search ..... 206/343, 806, 466; 339/224, 227

[56] References Cited

U.S. PATENT DOCUMENTS

| | | | |
|---|---|---|---|
| 3,409,865 | 11/1968 | Shannon | 339/227 |
| 3,532,212 | 10/1970 | Gatton et al. | 206/343 |
| 3,764,002 | 10/1973 | Spiegel et al. | 206/466 |

FOREIGN PATENT DOCUMENTS

| | | | |
|---|---|---|---|
| 3762 | 6/1891 | Switzerland | 206/343 |

*Primary Examiner*—Joseph Man-Fu Moy
*Attorney, Agent, or Firm*—Jack E. Dominik

[57] ABSTRACT

A method for fabricating a plurality of reinforced battery terminal connectors is shown in which a strip of a multiple of hard conductive metal inserts are formed with a flat cable connector portion for each unit having a joint between each insert. A line of weakness is provided at the joint and thereafter the strip is inserted into a mold, ideally ten or twelve at a time, and a material poured into the mold surrounding the strip to form the exterior configuration of a battery terminal. Once the same is removed from the mold a plurality of reinforced terminal connectors are formed joined by a line of weakness which permits them to be readily separated from each other. A modified form of the invention includes the further steps of preparing a clamp display strip having a plurality of clamping members secured by a weakened break away to a display strip. The clamping members are then secured to the plurality of reinforced terminal members by means of the self-tapping screws which secure the clamp to the cable connector portion of the terminal securing the cable in position. The apparatus is the product formed by the above method, in six alternative forms. The first form has a pair of jaws for securing the apertured portion to a battery post. The second form has a flat terminal connector portion for mounting to the side mount of a battery. When the terminal connectors are formed of a plastic, the third and fourth embodiments modify the first and second by providing exposed portions of the conductive metal inserts to insure good electrical contact.

The fifth embodiment is a plastic covered terminal connector and cable formed integrally. The sixth embodiment utilizes an integrally formed reinforcement, display strip, and clamp.

18 Claims, 46 Drawing Figures

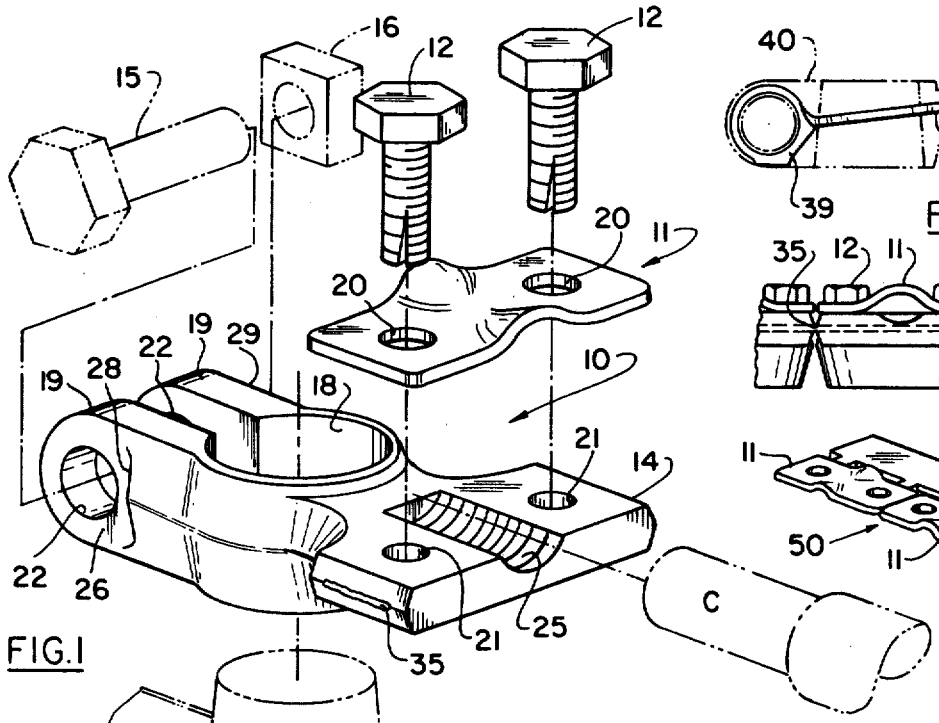
FIG.1
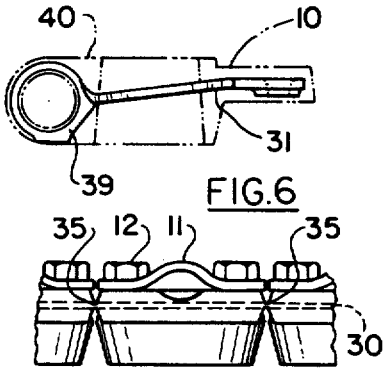
FIG.6
FIG.7
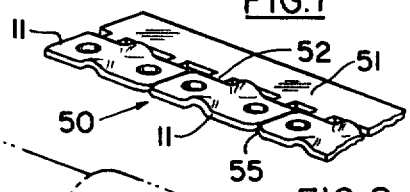
FIG.8
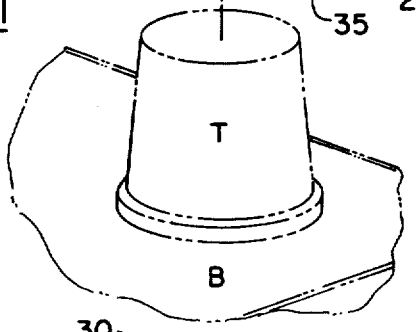
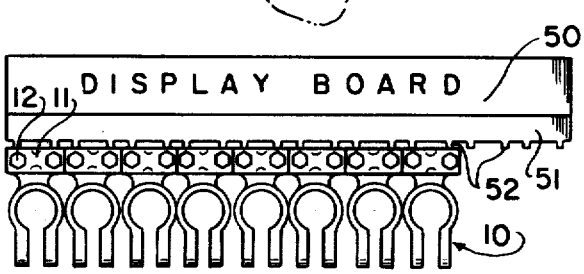
FIG.9
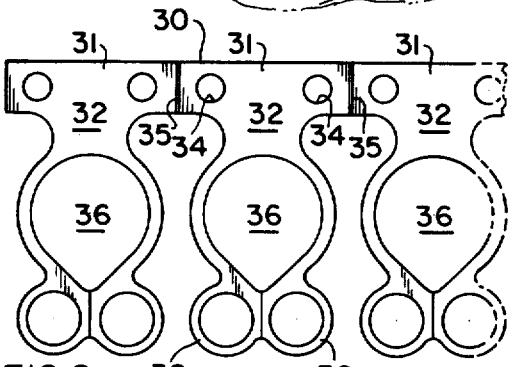
FIG.2
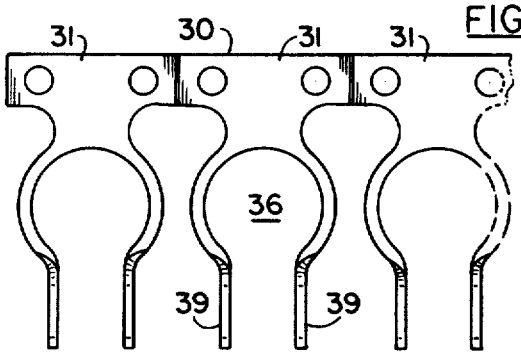
FIG.3
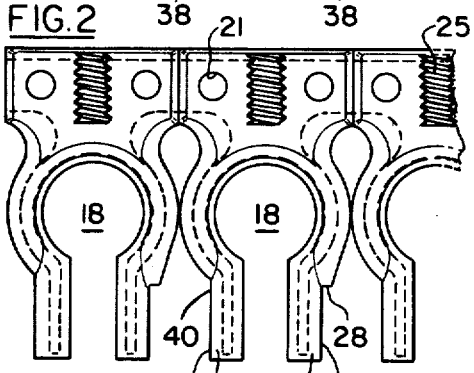
FIG.4
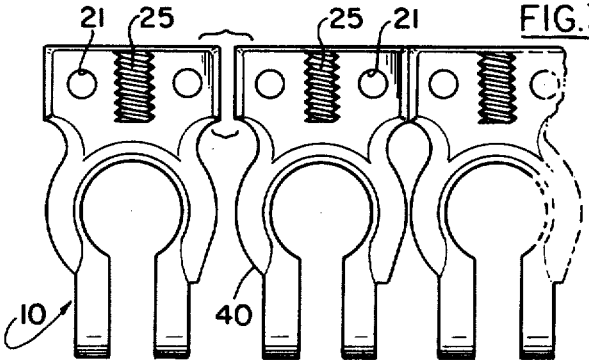
FIG.5

238
231
236

238
231

23
232
23
230
239
236

239
231

231
25
235
25
C

C

27
W
27
C

C 29
252
29
C

33
C
33

31
31
252
232
W
C 232
239
239

W
219
218
240
C
255
219

34
C
34

240
35
216
254
210
240
35
C
37
37

226
219
228
215
210
240
219
254
C
222
218

T
B

BATTERY TERMINAL CONNECTOR AND METHOD

FIELD OF THE INVENTION

The present invention relates to battery terminal connectors and a method for forming the same; the subject connectors being susceptible of mounting on a battery terminal post, or a side mount on a battery.

THE PRIOR ART

A reinforced battery terminal connector is shown and described in U.S. Pat. No. 3,409,865 by the applicant herein. The terminal connector or clamp as shown in U.S. Pat. No. 3,409,865 does not utilize an independent stamping in the embodiment shown in FIGS. 1–4, however it does in FIGS. 5–7. The battery terminal connector of U.S. Pat. No. 3,409,865 is shown in a form where they are made individually in individual molds. Such connectors are normally formed, when not reinforced, with a 100% lead alloy of approximately four ounces. The method of manufacture is slow, not readily susceptible to automation, and in addition to requiring the units to be made one at a time, packaging is similarly on a one at a time basis.

SUMMARY

The present invention derives from a method for fabricating a plurality of reinforced battery terminal connectors in which a strip of multiple of hard conductive metal inserts are formed with a flat cable connector portion for each unit having a joint between each insert. A line of weakness is provided at the joint and thereafter the strip is inserted into a mold, ideally ten or twelve at a time, and a material poured into the mold surrounding the strip to form the exterior configuration of a battery terminal. Once the same is removed from the mold a plurality of reinforced terminal connectors are formed joined by a line of weakness which permits them to be readily separated from each other. A modified form of the invention includes the further steps of preparing a clamp display strip having a plurality of clamping members secured by a weakened break away to a display strip. The clamping members are then secured to the plurality of reinforced terminal members by means of the self-tapping screws which secure the clamp to the cable connector portion of the terminal securing the cable in position.

The apparatus is the product formed by the above method, in six alternative forms. The first form has a pair of jaws for securing the apertured portion to a battery post. The second form has a flat terminal connector portion for mounting to the side mount of a battery. When the terminal connectors are formed of a plastic, the third and fourth embodiments modify the first and second by providing exposed portions of the conductive metal inserts to insure good electrical contact. The fifth embodiment is a plastic covered terminal connector and cable formed integrally. The sixth embodiment utilizes an integrally formed reinforcement, display strip, and clamp.

It is a principal object of the present invention to provide a battery terminal connector and method of making the same which is inexpensive and efficient to form, and at the same time reduces the quantity of higher priced lead or plastic-forming material.

A further object of the present invention is to provide a method and a product susceptible of packaging and shipping in multiples, and readily removed each from the other for ultimate usage.

Still another object of the present invention is to provide a plurality of battery terminal connectors in which the clamps are provided in multiples as well, ideally integral with a break away member and a display strip for mounting the same with the clamps and clamp bolts integrally in the package.

ILLUSTRATIVE DRAWINGS

Further objects and advantages of the present invention will become apparent as the following description of preferred embodiments proceeds, taken in conjunction with the accompanying drawings, in which:

FIG. 1 is an enlarged perspective exploded view of the first embodiment terminal post connector which is intended for mounting on a battery terminal post usually found on the top corners of a battery;

FIG. 2 is a plan view of the reinforcement strip employed interiorly of the terminal post connector;

FIG. 3 is a sequential view of the reinforcement strip after the eyes have been rotated 90°;

FIG. 4 shows the multiples of reinforced terminal post connectors after being molded, and illustrating in phantom lines the reinforcement strip;

FIG. 5 is a sequential view from that shown in FIG. 4 illustrating how one of the reinforced terminal post connectors is removed from the strip by breaking along a line of weakness joining the units;

FIG. 6 is a side view of the battery post connector showing the reinforcement in the configuration of FIG. 3 and the body material in phantom lines;

FIG. 7 is an end view of the reinforced terminal post connector taken at the end where the cable is secured by means of the clamp;

FIG. 8 is a perspective view of a clamp display strip in which a plurality of clamps are formed integrally with a display strip having a break away portion for removing the clamp from the display strip;

FIG. 9 shows a plurality of the reinforced terminal post connectors with the clamps and clamp display strips mounted to a display board;

Figure 20:
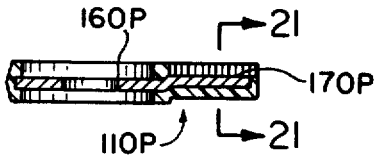
FIG. 20 is a longitudinal transverse sectional view of the side mounted terminal connector of FIG. 17 taken along section line 20—20 of FIG. 17.
Figure 21:
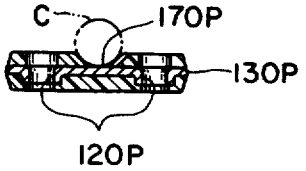
Figures 22, 23, 24, 25, 26, 27, 28, 29, 30, 31, 32, 33, 34, 35, 36, 37:
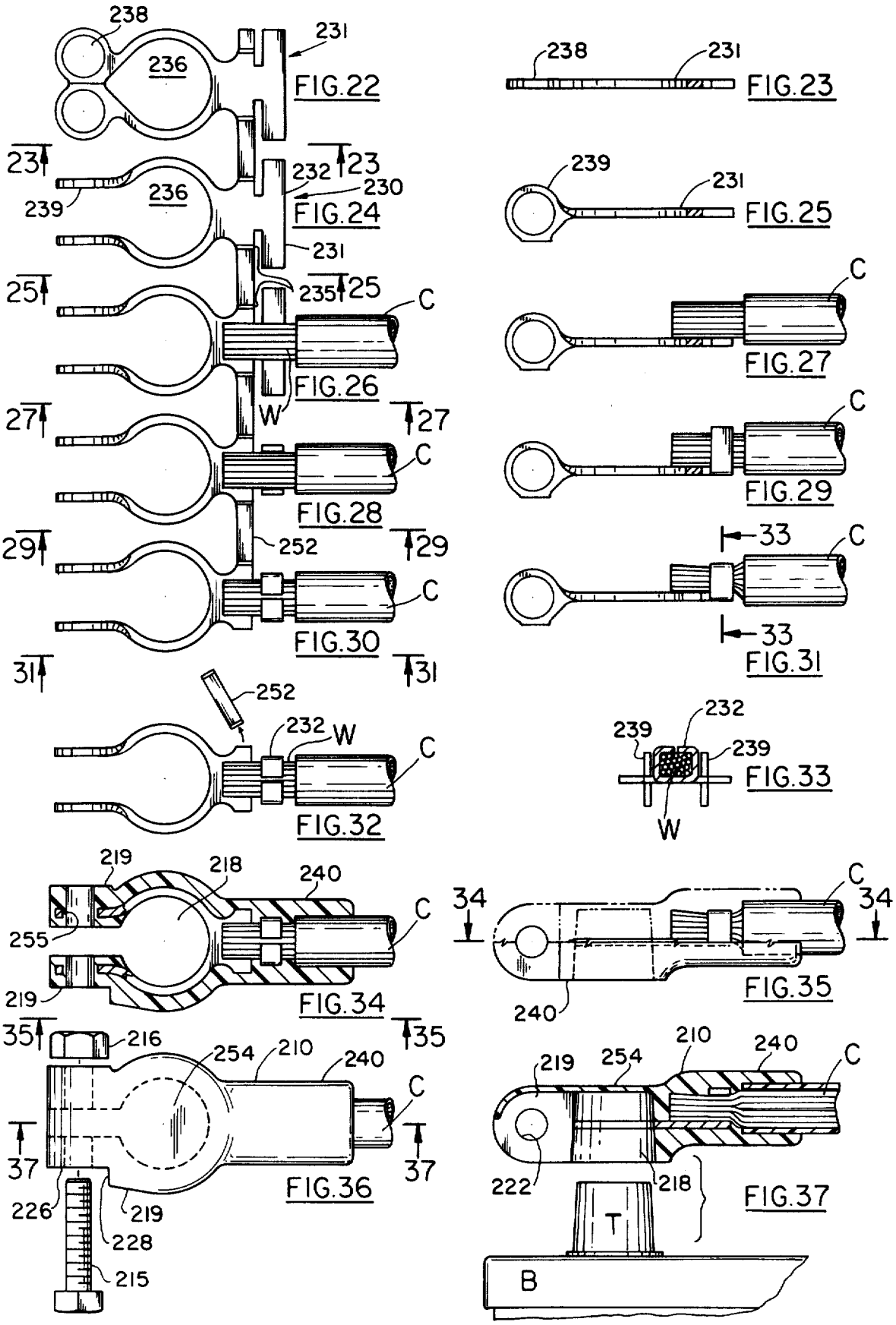
Figure 38:
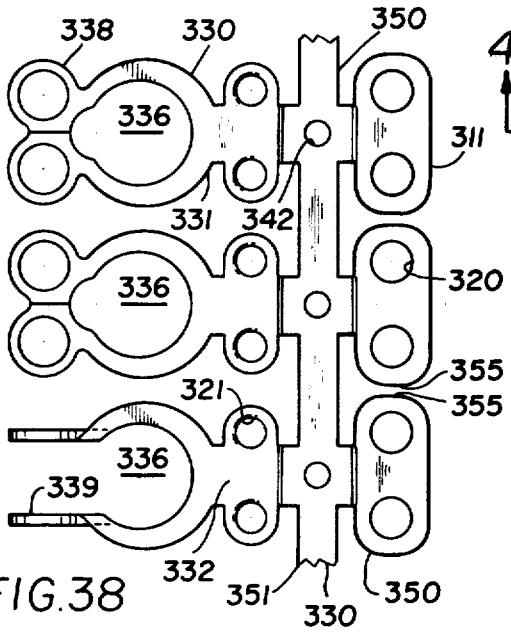
Figure 41:
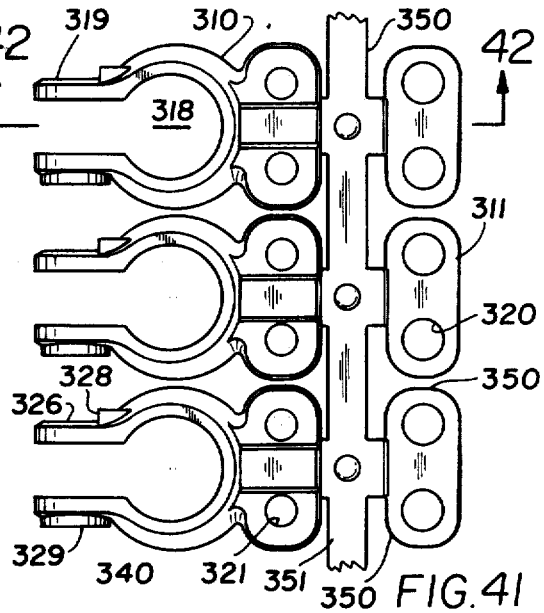
Figure 39:
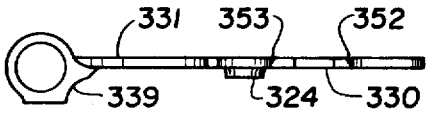
Figure 42:
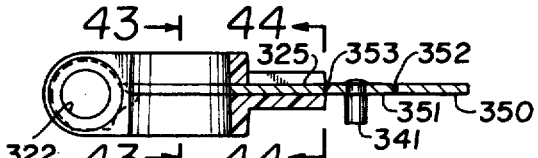
Figure 40:
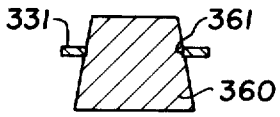
Figure 43:
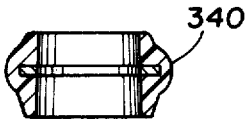
Figure 44:
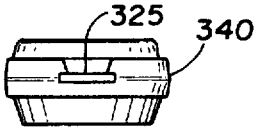
Figure 45:
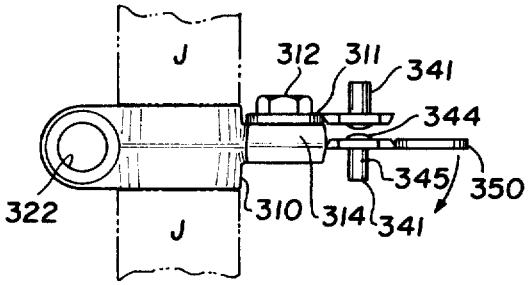
Figure 46:
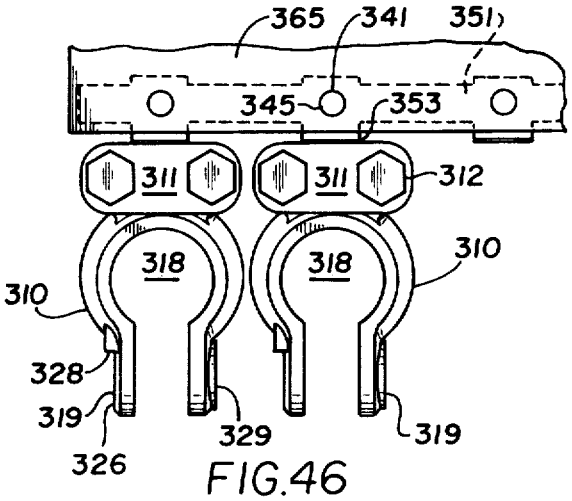

FIG. 21 is a transverse sectional view of the connector of FIG. 20 taken along section line 21—21 of FIG. 20; and FIGS. 22–37 inclusive show a fifth alternative embodiment in which FIGS. 22, 24, 26, 28 and 30 are a plan sequential view of the reinforcement being secured to the cable and FIGS. 23, 25, 27, 29 and 31 show a side view of their respective previous digit figure;

FIG. 32 is a plan view of the completed cable connection to the reinforcement;

FIG. 33 is a transverse sectional view of the same taken along section line 33—33 of FIG. 31;

FIG. 34 is a view sequential of FIG. 32 showing the terminal post connector having its plastic body material in surrounding relationship to the reinforcement;

FIG. 35 is a front view of the terminal as shown in FIG. 34;

FIG. 36 is a top view of the terminal connector ready for being secured to the terminal of a battery;

FIG. 37 is a longitudinal sectional view of the terminal connector shown in FIG. 36 taken along section line 37—37 of FIG. 36;

FIG. 38 discloses another embodiment showing in plan view the single stamping which includes the reinforcement, display strip, and clamp;

FIG. 39 is an end view of the stamping shown in FIG. 38;

FIG. 40 is a partially diagrammatic view of a core in the mold for molding the body portion of the terminal;

FIG. 41 is a plan view in the same scale as FIG. 38 showing the terminals after the body portion has been molded;

FIG. 42 is a transverse sectional view taken along section line 42—42 of FIG. 41;

FIG. 43 is a further sectional view of the terminal taken along section line 43—43 of FIG. 42;

FIG. 44 is an end view of the terminal taken along section line 44—44 of FIG. 42;

FIG. 45 is another side view of the terminal connector illustrating diagrammatically how a portion of the clamp display strip is removed; and FIG. 46 is a plan view of the completed terminals mounted to a display board.

INTRODUCTION

In FIGS. 1–9 of the accompanying drawings, a first embodiment terminal post connector 10 is disclosed and described as well as a method for making the same, and securing it to a display board. In this embodiment the reference numerals are two digit numbers.

In FIGS. 10–15 inclusive, a first alternative embodiment side terminal connector 110 is disclosed and described as well as its method for securing the same to a display board. In this second embodiment of the side terminal connector 110, reference numerals in the one-hundred series are employed. Where the parts are substantially identical to or common with the first embodiment, the second two digits in describing the reference numeral for the second embodiment and other embodiments are the same as the first embodiment. The apparatus and method for mounting both embodiments to the display board are substantially identical, and therefore the description in the first embodiment is essentially the same as that in the second embodiment.

Figure 16:
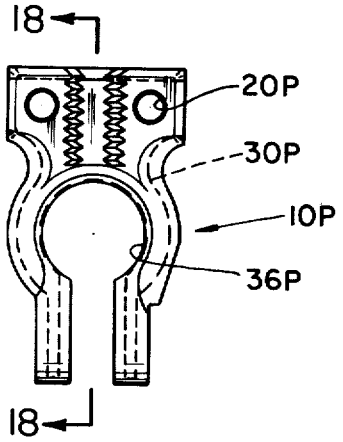
FIG. 16 is a plan view of a third alternative embodiment showing the terminal post connector of FIG. 1 but wherein the body portion is plastic.
Figure 17:
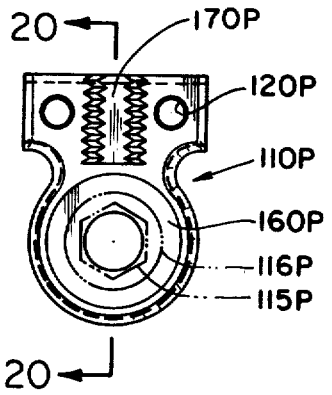
FIG. 17 is a fourth embodiment in plan view of the side mounted terminal connector of FIG. 10, but modified wherein the body portion is essentially a plastic.
Figure 18:
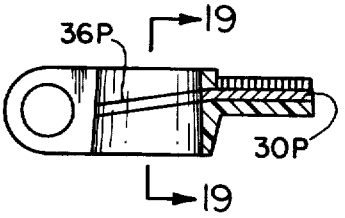
FIG. 18 is a longitudinal transverse sectional view of the terminal connector shown in FIG. 16, taken along section line 18—18 of FIG. 16.
Figure 19:
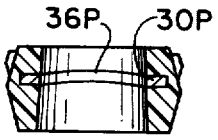
FIG. 19 is a sectional view of the terminal post connector of FIG. 18 taken along section line 19—19 of FIG. 18.

In FIGS. 16, 18 and 19 inclusive, a third alternative embodiment of the terminal post connector is shown. Reference numerals are similar to the embodiment of FIG. 1–9 except the letter "P" is used with the reference numeral. The fourth alternative embodiment shown in FIGS. 17, 20 and 21 is of the first alternative embodiment shown in FIGS. 10–15 but utilizing the reference modification "P" to denote the plastic body configuration.

The fifth embodiment uses the reference numerals in the 200 series and covers FIGS. 22–37. The sixth embodiment shown in FIGS. 38–46 uses reference numerals in the 300 series.

FIRST EMBODIMENT TERMINAL POST CONNECTOR

In FIG. 1 a battery terminal post connector is shown wherein it will be seen that the battery B (in phantom lines) has an upstanding terminal T, and the terminal post connector 10 is intended to clampingly interconnect the cable C to the battery terminal T. The interconnection is made by means of the clamp 11 which, when secured by the clamp bolts 12 to the cable connector 14 by means of the clamp bolts 12 secures the cable C to the terminal post connector 10. Thereafter the connector bolt 15 and connector nut 16, when the terminal aperture 18 is in surrounding engagement with the terminal T, urge the jaws 19 to clamp the terminal post connector 10 in place when the connector bolt and nut 15, 16 are secured.

To be noted as the configuration of the clamp 11 having two clamp holes 20 in coaxial arrangement with the connector holes 21 of the cable connector 14. The jaw holes 22 are provided in the jaws 19 for securing the connector bolt 15 and connector nut 16. The clamp 11 is provided with a clamp recess 24 opposingly positioned to the connector recess 25. The connector recess may have threads, ridges, or other interruptions contained therein to more securely engage the end of the cable C. To assist in securing the connector bolt and connector nut 15, 16 a bolt head flat 26 is provided on one of the jaws 19, and having a bolt head shoulder 28 to secure the head of the bolt 15 while the connector nut 16 engages the bolt 15 and ultimately clamps against the nut flat 29 of one of the jaws 19. The terminal post connector essentially as thus described to the outside appearance is comparable to the prior-art terminal post connectors. The inventive concept is directed to the interior reinforcement, and more particularly the method and apparatus for forming a plurality of the subject terminal post connectors 10 in a strip through the medium of a reinforcement strip 30 as shown in FIG. 2. The reinforcement strip 30, as described earlier, may contain any number of reinforcement 31 depending upon the multiple of terminal post connectors 10 to be formed. The reinforcement strip 30 and the accompanying reinforcements 31 include a cable portion 32 having clamp holes 34 with each reinforcement 31 separated from its adjacent reinforcement 31 by means of a line of weakness 35. An aperture 36 is provided at the central portion of each reinforcement 31 for mounting to the associated battery terminal. In the first embodiment, it will be noted that opposite the aperture 36 are a pair of opposed eyes 38 when, when twisted 90°, define twisted eyes 39 as shown in FIG. 3.

After the reinforcement strip 30 is thus formed with the twisted eyes 39, the same is positioned in a mold and the body 40 formed around the reinforcement strip 30 as shown in FIG. 4 where the reinforcement strip 30 is shown in dotted lines and the body 40 in solid lines, including the formation of the connector recess 25 in the cable connector portion 17 of the terminal post connector 10. FIG. 5 illustrates how one of the terminal post connectors 10 at the left-hand portion can be removed from the series by bending the same along the line of weakness 35, the only evidence of the tear being the ruptured portion of the line of weakness 35 as shown in FIG. 1. In FIG. 6 the twisted eye 39 is shown in its frontal view with the body 40 of the terminal post connector 10 shown in phantom lines. FIG. 7 is an end view of the terminal post connector 10 illustrating the line of weakness 35 in the reinforcement strip 30 with the reinforcement strip 30 being shown in dotted lines.

In accordance with a supplemental aspect of the present invention, a method and means for mounting the terminal post connectors 10 in their multiples is shown in FIGS. 8 and 9. There it will be seen that a clamp display strip 50 is formed having one portion of a display strip 51, connected by breakaways 52 to the clamps 11. The clamp edges 55 may be secured by means of a line of weakness, or severed. The function of the clamp 11, thereafter, is to (as shown in FIG. 9) secure the plurality of clamps 11 by means of the clamp bolts 12 to the terminal post connectors 10. The display strip 51 is then secured to a display board in accordance with varying techniques known in the art, and thereafter the display board is desirably in a visual form.

SIDE TERMINAL CONNECTOR ILLUSTRATIVE SECOND EMBODIMENT

Figure 10:
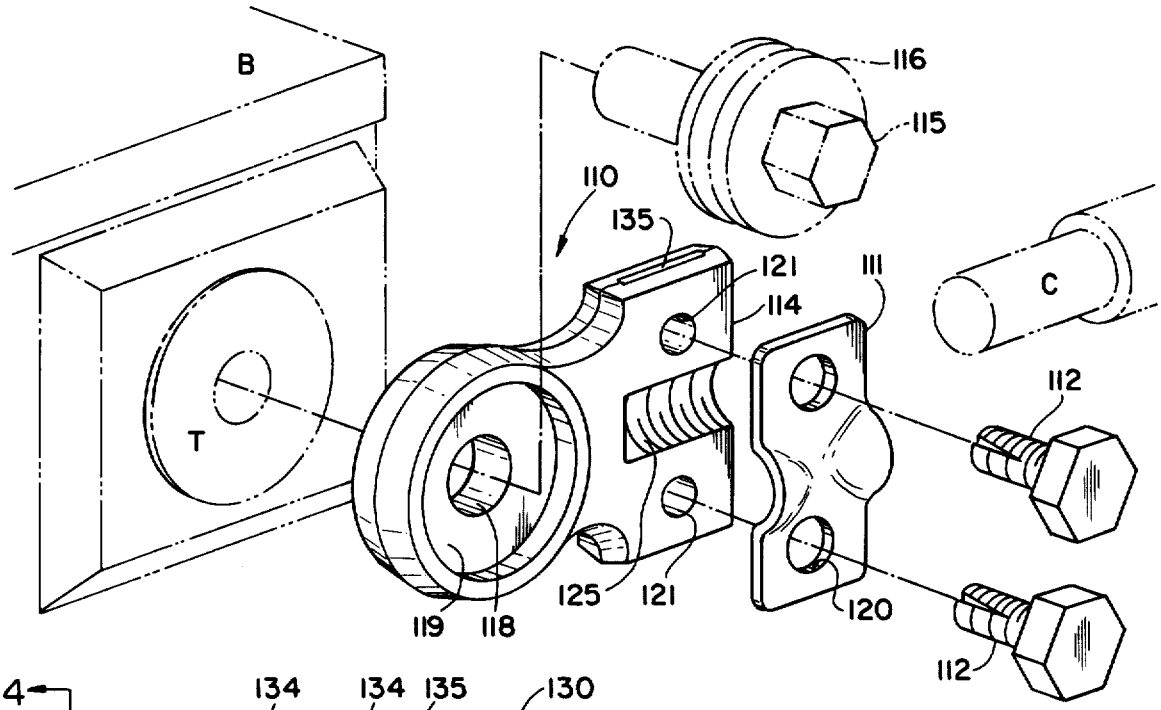
FIG. 10 is an enlarged exploded perspective view of a side mounted reinforced battery terminal connector forming an alternative embodiment of the present invention.
Figure 11:
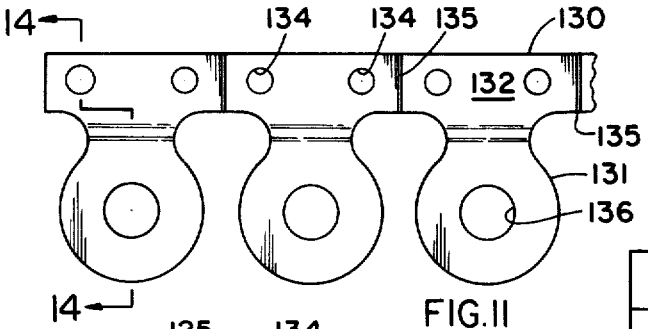
FIG. 11 is a plan view of the reinforcement strip of the alternative embodiment reinforced battery terminal connector.
Figure 15:
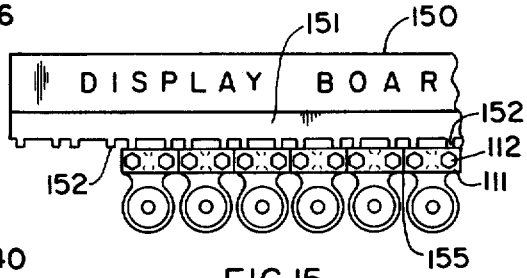
FIG. 15 is comparable to FIG. 9 showing how the side mounted terminal connectors can be secured to a display board by forming a clamp display strip.

The side terminal connector 110 is shown in FIG. 10 where it will be seen that the clamp portion 111 is substantially identical to the clamp 11 shown in the embodiment of the terminal post connector 10. The clamping bolts 112 are then employed to engage the cable connector 114 and secure the cable C to the side terminal connector 110. The side terminal connector 110 is thereafter secured by means of the connector bolt 115 and its bolt flap 116 interiorly of the terminal aperture 118 with its surrounding bolt flap recess 119 to the terminal T. Clamp holes 120 are provided in the clamp 111, and are coaxial with the connector holes 121 of the cable connector 114. Similarly as with the terminal post connector 10, a clamp recess 124 is provided in the clamp 111, and a corresponding connector recess 125 in the side terminal connector 110.

The reinforcement strip 130 includes a plurality of individual reinforcements 131 having a cable portion 132 with clamp holes 134. Similarly as with the terminal post connector 10, a line of weakness 135 is provided between each cable portion 132 of the reinforcement members 131. The aperture 136 ultimately surrounds the terminal aperture 118.

Figure 12:
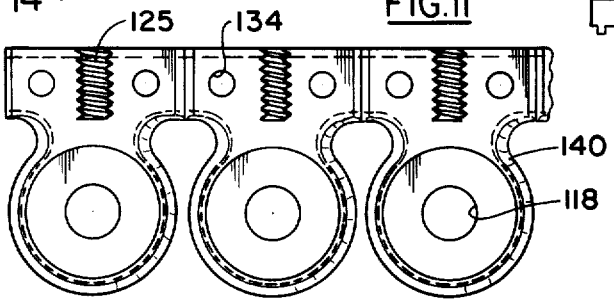
FIG. 12 is a sequential view from FIG. 11 in the method showing the alternative side terminal connector after the body material has been molded.
Figure 14:
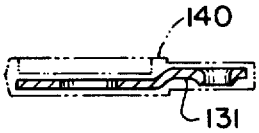
FIG. 14 shows a side view of the alternative side mounted battery terminal connector taken along section 14—14 of FIG. 11 showing the reinforcement in section, and the body material in phantom lines.
Figure 13:
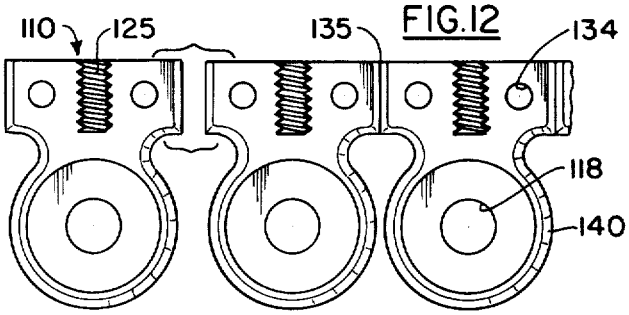
FIG. 13 is a further sequential view of the side terminal connector showing one of the connectors removed by breaking along the line of weakness.

Then in accordance with the method, the reinforcement strip 130 is placed in a mold, and the body 140 cast around it to a resulting configuration as shown in FIG. 12 where the reinforcement strip 130 is shown in dotted lines. In FIG. 13, it will be seen how a single side terminal connector 110 can be separated from the strip by means of breaking along the line of weakness 135, also as shown in FIG. 10. FIG. 14 shows the longitudinal sectional view taken through the reinforcement 131, and showing the body 140 in phantom lines.

The mounting to the display board 150 by means of the display strip 151 having breakaways 152 and clamp edges 155 is substantially identical with the description of the first embodiment as shown and described in FIGS. 8 and 9.

THIRD EMBODIMENT TERMINAL POST CONNECTOR-PLASTIC

Shown in FIG. 16 is a third alternative embodiment terminal connector 10P which for purposes of utilization is an alternative of that of the first embodiment. To be noted is the provision of clamp holes 20P in which the metal portion of the reinforcement 30P is slightly reduced in size to insure metal to metal contact with the clamp bolts 12P. Similarly, the aperture 36P is left exposed so that there is metal to metal contact with the terminal T of the battery B. This is also shown in FIGS. 18 and 19.

SIDE TERMINAL CONNECTOR ILLUSTRATIVE FOURTH EMBODIMENT-PLASTIC

The side terminal connector 110P as shown in FIG. 17 has been modified for molding out of plastic for the body portion. A metal exposed area 160P is provided to bear against the bolt flat 116 of the connector bolt 115. Similarly, an exposed metal portion 170P is provided to have metal to metal contact with the cable C when the clamps 111P are secured thereto. As with the third embodiment 10P, the clamp holes 120P are either undersized to receive self-tapping clamp bolts, or provided to have exposed metal portions to insure electrical contact with the clamp bolts 112P.

BREAK-AWAY OPTIONS

Varying options are available for packaging and manufacturing considerations with regard to the lines of weakness. For example, the cable clamps may remain connected to each with a line of weakness, with the terminal connectors severed from each other. This will hold the plurality of terminal connectors, irrespective of whether it is embodiment 1, 2, 3 or 4, together. The display strips may then be used for securing to packaging, or may be removed where the display strip is not employed to facilitate packaging. Alternatively, the cable clamps and the terminals may be severed, the only connection between the adjacent units being the display strip. Yet another alternative is to leave the terminals connected to each other with their respective lines of weakness, and have the clamps severed. With this option, the display strip may be removed, or may also be employed. Finally, the display strip having served its function in accordance with the method of orienting a plurality of terminals for casting simultaneously, and after the clamps have been secured, may be removed with the terminals and their respective clamps being separated, and the units packaged individually or in any number in a typical bag packaging.

The principal advantage of utilizing the display strip in combination with the various lines of weakness is to preserve all of the above options for purposes of manufacture, and subsequent packaging for marketing.

FIFTH EMBODIMENT

The fifth embodiment of the subject terminal post connector is shown in FIGS. 22–37. In its completed form, as shown in FIGS. 36 and 37, the terminal post connector 210 is integrally secured to a cable C, and the same may be positioned on the terminal post T of a battery B by means of a standard connector bolt 215 and its related connector nut 216 which pass through the jaw holes 222 of the jaws 219 to shrink the terminal aperture 218 to secure the same to the battery post terminal T. Bolt head flats 226 and bolt head shoulders 228 are employed to secure the head of the bolt 215 from rotation while the connector nut 216 is applied.

In forming the fifth embodiment terminal post connector and integral cable C a reinforcement strip 230 is suitably punched from an appropriate reinforcement metal, just as in the previous four embodiments. As shown from top to bottom sequentially in FIGS. 22, 24, 26 and 28 the reinforcement strip 230 has a plurality of reinforcements 231, each of which has a cable portion 232, and a plurality of lines of weakness 235 adjacent break-away sections 252. As noted in FIGS. 22 and 24 a terminal aperture 236 is provided in each reinforcement 231 and eyes 238, as shown in FIG. 22 are prepared which are sequentially twisted to form twisted eyes 239 as shown in FIGS. 24 and 25.

Again as shown in sequence in FIGS. 22–31, the cable C is positioned centrally of the cable portion 232, and the cable portion 232 is thereafter wrapped around the stripped wire portion W of the cable C to where the condition shown in FIGS. 30, 31 is completed. At this point, the break-away 252 is removed, and each of the reinforcements 231 and its associated cable C are ready for finishing by means of preferred plastic molding thereabout. The units are then placed in a suitable mold, and preferably plastic molded to form the body 240 as shown in FIGS. 34–37 inclusive. As noted particularly in FIG. 37, care is taken in the mold to make sure that the metal reinforcement 231 extends inwardly into the terminal aperture 218 for metal-to-metal contact with the terminal post T. To be noted also is the membrane 254 remaining on the top of the terminal aperture 218.

In normal manufacturing techniques the reinforcement 231 when crimped to the wire W of the cable C is preferably tinned to insure good conductivity. Since the terminal is molded from non-conductive plastic any conductive object touching the two terminal clamps on a battery would not short out the battery. To further guard against accidental electrical shorting, however, the thin plastic membrane 254 is provided integrally across the terminal aperture 218. This reduces the possibility of accidental shorting causing sparks which in turn can cause explosive forces with hydrogen gas generated in batteries. For a further insulation, plastic connector bolts 215 and nuts 216 may be employed.

To be noted also, particularly in FIG. 34 is the thin membrane 255 in the jaw holes 222 which serves to insulate the connector bolt 215 from the reinforcement 231.

SIXTH EMBODIMENT

The sixth embodiment of the subject terminal post connector 310 is shown in FIGS. 38–46 inclusive. The completed terminal post connector 310 is shown in FIG. 46 where the clamps 311 are positioned in their operative relationship to the connector 310 by means of clamp bolts 312. The cable connector portion 314 of the terminal post connector 310 appears in its finished form in FIG. 45. Each terminal post connector 310 has a battery terminal aperture 318 as shown in FIG. 46, terminating in opposed jaws 319. The clamp holes 321 are shown in FIG. 41, and the jaw holes 322 appear in FIGS. 41, 42, and 45. Each connector hole 321 has a depending connector hole bolt collar 324 to receive the clamp bolts 312. A connector recess 325 is provided above the connector 332 so that good electrical contact is made when the cable is positioned beneath the clamp 311. Mounting for the jaw bolt (not shown) is provided by a bolt head flat 326 and a bolt head shoulder 328, in opposed relationship to the nut flap 329.

The reinforcement strip 330 includes the reinforcement portion 331 terminating at one portion in the connector portion 332, and at the opposed ends in eyes 338, having jaw holes 322, the eyes 338 being formed as twisted eyes 339 as illustrated in FIG. 38 and FIG. 39. An aperture 336 is provided centrally in the reinforcement 331 to receive the battery terminal post.

The assembly as shown in FIG. 38, after all of the eyes 338 have been formed to twisted eye forms 339 is then positioned in a mold. The body 340 is then cast about the reinforcement 331 essentially as shown in FIGS. 41, 42, 43, and 44. The body may be plastic, lead, or other formable material. When the body is cast, the mold sufficiently overlaps the clamp display strip 350 so that display mount rivets 341 are formed in the display mount rivet holes 342. Each display mount rivet 341 has a rivet head 344, and an extending rivet body 345 used for display mounting as will appear.

The clamp display strip assembly 350 as shown in FIG. 45 is then removed from the terminal 310 while the terminal 310 is secured between opposed jaws J as shown in FIG. 45. As further shown in FIG. 42, it will be seen that the clamp display strip 350 is provided with clamp breakaway line of weakness 352, and display strip breakaway line of weakness 353. The entire clamp display strip 350 for the multiples, whether six, ten, or twelve, then becomes the clamp display strip 350 of the next sequence being formed. As will be seen, the clamp edges 355 are separated from each other, and the clamps 311 are secured to the terminal as shown in FIGS. 45 and 46. In forming the terminal body 340, as will be seen in FIG. 40, a core 360 is inserted in the mold having a core ledge 361 which inhibits the body material 340 from sealing off the metal-to-metal contact provided by the aperture 336 interiorly of the terminal post connector, as shown in cross-sectional view in FIG. 43.

When mounting for display, the multiple of terminal post connectors 310 are secured to a display board 365, with the rivet bodies 345 extending through the display board 365 to secure the terminal connectors thereto. When each terminal connector 310 is desired for usage, it is bent and broken away from the display strip 351 along the breakaway line 353 as shown in FIG. 46.

THE METHOD

The method of the present invention relates to the fabrication of a plurality of reinforced battery terminal connectors, whether for mounting on a battery terminal post, or side mounted on a battery. The first step in the method is to form a strip of a multiple of connector reinforcements having a flat cable connector portion for each unit and the multiples of units being joined by a line of weakness or breakaway portion. Thereafter the inserts are provided with an aperture for securing in physical and electrical connection to a battery terminal, whether of the post type or side mounted. The strip is then inserted into a mold, and six, ten, twelve or whatever number are to be molded are cast simultaneously. Ideally the clamp holes 34, 134 are utilized to jig the reinforcement strips 30, 130 within the mold. The body 40, 140 is then formed by casting lead, plastic or other formable material into the mold. The reinforcement strip 30, 130 is normally conductive, and strong enough to reinforce the terminal connector 10, 110 and yet maleable enough that the same can be separated at the line of weakness 35, 135, 352, 353. The further step in the method is directed to the provision of clamp display strips in which the individual clamps 11, 111 are formed in multiples and secured by means of breakaways 52, 152 to the display strip portion 51, 151 of the clamp display strip 50, 150. In each instance, a line of weakness or parted clamp edge 55, 155 permits the separation of each of the individual clamps 11, 111 from the other. The clamp bolts 12, 112 secure the clamps 11, 111 to the individual terminal post connectors 10, 110 which may at this time, but not necessarily, be secured to each other by the lines of weakness 35, 135. Where the cable is molded into the connector and clamped by the reinforcing member, the desirability of a plurality of reinforcement is also employed.

The method of forming the sixth embodiment terminal post connector 310 contemplates first providing a reinforcement strip 330 which includes the terminal reinforcement 331, the connector portion 332, the display strip 351, and the clamps 311. The eyes 338 are formed as twisted eyes 339 prior to molding the body 340 around the reinforcement strip 330 as shown in FIG. 41. In the forming of the body 340, a core 360 having a ledge 361 is inserted into the aperture 336 of the reinforcement 331 to shut off fluid flow interiorly of the aperture 336 to provide metal-to-metal contact with the battery terminal as shown in FIG. 43. The cores 360 have a taper of approximately 3°, but the ledge 361 has essentially zero taper. Simultaneously with the forming of the body 340, the display mount rivets 341 are formed in the display mount rivet holes 342 in the display strips 351. The clamp display strip 350, as shown in FIGS. 41 and 45, is then broken away from its multiple, and assembled to an adjacent multiple in which the display strip 351 holds the clamps 311 in oriented configuration so that the clamp bolts 312 can be readily applied to threadedly engage the connector holes 321 and the connector hole bolt collars 324. The completed unit is thereafter secured to the display strip 365 with the rivet bodies 345 extending through holes in the display board 365, all as shown in FIG. 46.

In review it will be noted that six types of battery terminal connectors, all reinforced, and all permitting mounting and manufacture in multiples have been shown and described. The first is a top terminal post connector 10, and the second side terminal connector 110. The third and fourth embodiments are plastic body modifications of the first and second connectors. The fifth is the integral connector and cable. In the sixth embodiment the reinforcement, display strip, and clamp are formed integrally from a single stamping. The method for forming the terminal connectors 10, 110 requires the usage of the reinforcement strips 30, 130 and the molding of the terminal connectors 10, 110 in multiples separated only by a line of weakness 35, 135. A supplemental aspect of the invention is directed to sequentially securing a plurality of clamps 12, 112 to a clamp display strip 150 having a display strip portion 51, 151 and breakaways 52, 152 to secure the respective clamps to the display strips which in turn are secured to the display boards.

Although particular embodiments of the invention have been shown and described in full here, there is no intention to thereby limit the invention to the details of such embodiments. On the contrary, the intention is to cover all modifications, alternatives, embodiments, usages and equivalents of the subject invention as fall within the spirit and scope of the invention, specification and the appended claims.

I claim:

1. A battery terminal having a reinforcement strip for a plurality of terminals which assists in orienting the strip for casting metal thereabout to form a plurality of severable terminals comprising, in combination, an interior reinforcement strip for a plurality of terminals formed of a conductive metal defining a terminal aperture at a mid-portion, said reinforcement being formed with a plurality of units terminating in a cable connector portion remote from the terminal aperture, each cable connector portion being substantially rectangular and having connector holes, each of said terminals being separated from the adjacent terminals by a line of weakness along an edge portion of the adjacent reinforcement portions formed in said reinforcement strip, said connector and holes serving to orient the reinforcement in a plurality of mold cavities, a connector body material formed to encase each of the plurality of members, the size and proportion of which defines the completed terminal connector, each of said terminals being readily severable from the adjacent unit by breaking along the line of weakness.

2. The battery terminal connector of claim 1, wherein said material encasing the reinforcement member is lead.

3. The battery terminal connector of claim 1, wherein said material encasing the reinforcement member is a plastic.

4. The battery terminal of claim 3, wherein said plastic is conductive.

5. In the battery terminal connector of claim 1, a clamp display strip for mounting the reinforced battery terminal connectors to a display board, one portion of the clamp display having a plurality of clamps, each clamp having holes in register with the cable connector holes, one portion of the clamp display defining a display strip, each clamp being secured by a breakaway member to the display strip, each clamp being secured to the connector portion of each reinforced battery terminal connector, whereby a plurality of terminal connectors and clamps may be mounted on a display board by said display strip.

6. In the battery terminal connector of claim 3, exposed conductive metal portions of the reinforcement position to receive the terminal mounting means.

7. In the battery terminal connector of claim 3, exposed metal portions of the reinforcement provided at the clamp holes to receive the clamp bolts in metal to metal electrical contact.

8. The reinforced battery terminal connector of claim 1, in which, said reinforcement is secured to a display strip by a line of weakness, said display strip includes in addition a clamp joined to said display strip by a second line of weakness, and said display strip is severed from the first line of weakness and positioned with the clamp portion secured to the cable connector portions of a set of battery terminal connectors.

9. The reinforcement battery terminal connectors of claim 8, in which, said display strip is provided with a plurality of spaced holes, and a plurality of upstanding rivet-like members are formed therein for assistance in securing the same to a display card.

10. The battery terminal of claim 1, wherein said material encasing the reinforcement member is lead.

11. The battery terminal connector of claim 1, wherein said material encasing the reinforcement member is a plastic.

12. In the battery terminal connector of claim 1, a clamp display strip for mounting the reinforced battery terminal connectors to a display board, one portion of the clamp display having a plurality of clamps, each clamp having holes in register with the cable connector holes, one portion of the clamp display defining a display strip, each clamp being secured by a breakaway member to the display strip.

13. In the battery terminal connector of claim 3, exposed conductive metal portions of the reinforcement position to receive the terminal mounting means.

14. In the battery terminal connector of claim 3, exposed metal portions of the reinforcement provided at the clamp holes to receive the clamp bolts in metal to metal electrical contact.

15. The battery terminal connector of claim 3, wherein said plastic is conductive.

16. A plurality of reinforced battery terminal connectors, comprising, in combination, a reinforcement strip formed with a reinforcement portion having a central terminal post aperture forming portion, eyes twisted to a plane perpendicular with the reinforcement strip aperture forming portion at one end thereof to receive a connector bolt, a connector portion opposite to the eyes at the other end of the aperture forming portion, a display strip connected to the connector portion of the reinforcement by a line of weakness, a plurality of clamps connected by a line of weakness to the display strip in opposed relationship to the connectors, a body portion molded in surrounding relationship to the reinforcement to thereby define the configuration of the terminal post connector, said display strip and clamps being removed from the terminal post connector and positioned atop the connector portion of the terminal post connector and secured by clamp securing means.

17. A reinforcement panel for forming a plurality of reinforced battery terminal connectors and for orienting in a multiple cavity mold in which each cavity has a central core pin comprising, in combination, an interior reinforcement having a plurality of terminal aperture forming portions for positioning in the mold around its central core pin, said reinforcement apertures having a plurality of cable connector portions remote from but adjacent to the terminal aperture forming portion, said cable connector portions being substantially rectangular and having two connector holes therein, each of said terminal units being separated from the adjacent said units by a line of weakness along an edge portion of each connector portion, said connector portion and holes serving to orient the reinforcement in a plurality of mold cavities.

18. The reinforcement panel of claim 17 above, in which, a pair of eyes are formed at a portion of the aperture forming portion and twisted into a plane perpendicular with the balance of the reinforcement panel.

* * * * *